United States Patent [19]

Kaste

[11] Patent Number: 4,499,811

[45] Date of Patent: Feb. 19, 1985

[54] BANK FIRING ATTACHMENT INCLUDING PIVOTAL LOCKING LUGS

[75] Inventor: Robert P. Kaste, Bel Air, Md.

[73] Assignee: The United States of America as represented by the Secretary of the Army, Washington, D.C.

[21] Appl. No.: 540,237

[22] Filed: Oct. 11, 1983

[51] Int. Cl.[3] ..... F41F 17/12

[52] U.S. Cl. ..... 89/14.5

[58] Field of Search ..... 89/14 E, 14 B; 42/1 F

[56] References Cited

U.S. PATENT DOCUMENTS 3,732,776 5/1973 Snodgrass ..... 89/14 E 3,744,370 7/1973 Snodgrass ..... 89/14 E

FOREIGN PATENT DOCUMENTS 545955 3/1956 Belgium ..... 89/14 E

*Primary Examiner*—Richard E. Schafer

*Assistant Examiner*—John S. Maples

*Attorney, Agent, or Firm*—Anthony T. Lane; Robert P. Gibson; Michael G. Sachs

[57] ABSTRACT

The present invention discloses a blank firing attachment for gun tubes of automatic or semi-automatic weapons when firing blank cartridges. The attachment includes a flash suppressor having milled axial slots threadably attached to the gun tube, a slidable cam pivotally mounted to a collar threadably attached to a shaft containing a restricted passage for gas flow from the gun tube, and a number of locking lugs pivotally connected to the collar. Axial movement of the shaft causes the lugs to engage the axial slots and the shaft to engage the gun tube end, thereby restricting gas flow from the gun and providing back pressure to permit automatic or semi-automatic firing of the weapon when using blank ammunition. Thus, the attachment is made compact and is fireable in all modes for various weapons, including M231 weapon.

4 Claims, 1 Drawing Figure

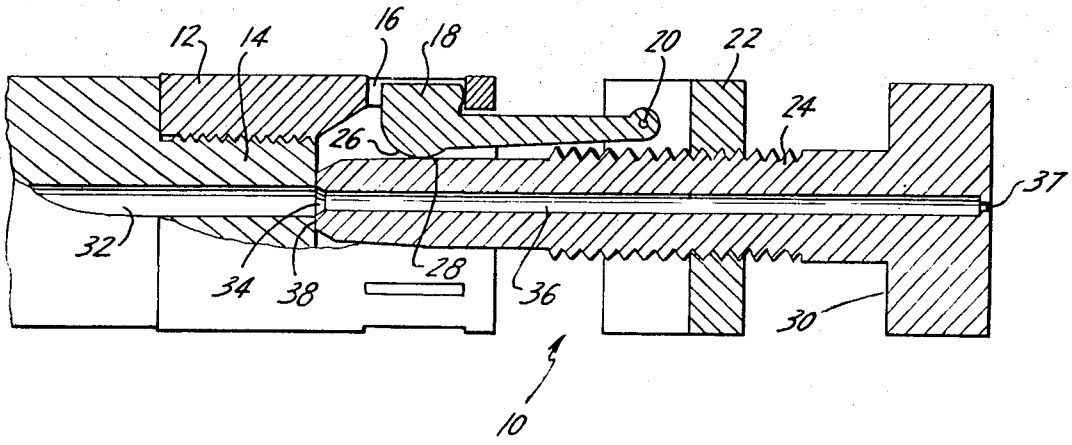
37
30
24
22
20
36
10
18
28
16
26
38
14
34
12
32

BANK FIRING ATTACHMENT INCLUDING PIVOTAL LOCKING LUGS

GOVERNMENTAL INTEREST

The invention described herein may be manufactured, used, and licensed by or for the Government for Governmental purposes without the payment to me of any royalties thereon.

BACKGROUND OF THE INVENTION

The present invention relates to a field of art dealing with automatic and semi-automatic weapons. Blank firing attachment devices are normally required to be fitted to gun tubes of automatic or semi-automatic weapons when firing blank cartridges. The fundamental function of a blank firing attachment is to restrict muzzle gas flow to provide the back pressure necessary to operate the feed mechanism for sequential movement of rounds into the chamber.

The basic shortcoming in prior art devices is related to an absence of a compact blank firing attachment which can fit to all gun tubes of automatic and semi-automatic weapons when firing blank cartridges. The prior art devices are bulbous shaped and larger than the muzzle diameter which requires corresponding clearance to fire through the aperture of a protective enclosure. Prior art blank firing attachments are not suitable for M231 weapons to be fireable in all modes through the firing ports of various armored vehicles.

Accordingly, the present invention is intended as a solution to the problem of presently available blank firing attachments as described hereinbefore.

SUMMARY OF THE INVENTION

The present invention relates to a blank firing attachment for gun tubes of automatic or semi-automatic weapons. This attachment includes a conventional flash suppressor having circumferentially or otherwise disposed axial slots normally used to vent gas radially but are employed according to the present invention to engage a plurality of locking lugs pivotally attached by a pin to a collar which is threadably attached to a shaft.

The locking is accomplished by the axial movement of the shaft which results in restricted exhaust of combustion gas, providing automatic and semi-automatic cycling of the weapon.

The axial movement of the shaft results from a tightening device, normally a socket head bolt.

It is the object of the present invention to provide simplified and reliable blank firing attachment.

It is another object of the present invention to provide a suitable blank firing attachment which can be fitted to weapons, including the M231 weapon, to be fireable in all modes through the firing ports of various armored vehicles.

It is a further object of the present invention to provide a compact attachment not exceeding the diameter of the gun tube and adapted to fire blank cartridges in automatic and/or semi-automatic weapons.

It is a further object of the present invention to provide an improvement over prior art blank firing attachments which are bulbous in geometry and larger than the muzzle diameter of the gun tube.

BRIEF DESCRIPTION OF THE DRAWING

The drawing represents a simplified cross-sectional view of an improved blank firing attachment of the present invention.

DESCRIPTION OF THE PREFERRED EMBODIMENTS

A general understanding of the present invention may be obtained with respect to the drawing.

The drawing shows a blank firing attachment 10 comprising a flash suppressor 12 threadably attached to a barrel 14 of a gun. The suppressor 12 has a plurality of circumferentially disposed axial slots 16 which are normally used to vent gas radially from a muzzle. However, according to the present invention, slots 16 are used to engage a plurality of locking lugs 18, each of which contains a slidable contact cam 26 and is pivotally connected by pin 20 to one end of a collar 22 threadably attached to a shaft 24. Locking is accomplished by axial movement of the shaft 24 to cam 26 along ram 28 such that locking lugs 18 are engaged to the slots 16. The fulcrum pin 20 is aligned to a position relative to the movement of the shaft 24 so that the locking lugs 18 are forced radially about the pin 20 to engage the slots 16 of the flash suppressor 12. A device 30, usually a socket head bolt, is attached to shaft 24 such that the axial movement of the shaft 24 is activated by torque produced by the tightening of the device 30. In operation, combustion gas passes through bore 32 to enter a reducer section 34 of a passage 36 and eventually to the atmosphere through a pre-sized control orifice 37. Gas is sealed against the premature escape by face contact along surface 38. Thus, the weapon is properly fireable using the improved blank firing attachment 10 in automatic and/or semi-automatic mode using blank ammunition.

Accordingly, while there have been shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

What is claimed is:

1. A blank firing attachment for gun tubes of automatic or semi-automatic weapons which comprises:

- a flash suppressor having circumferentially disposed axial slots threadably attached to the gun tube end;
- a shaft containing a passage for restricting gas flow from said gun tube;
- a collar threadably attached to said shaft;
- a plurality of locking lugs, each being pivotally connected at one end to said collar and having a lug for engagement to said axial slots;
- a slidable cam means connected to each of said locking lugs and arranged to slide along said shaft to force said lugs to engage said slots, whereby rotation of said shaft in said collar effects axial movement of said shaft to cause said lugs to engage said axial slots and said shaft to engage said gun tube end, thereby restricting gas flow from said gun tube to provide sufficient back pressure to permit automatic and semi-automatic firing of the weapon when using blank ammunition.

2. A blank firing attachment for gun tubes of automatic or semi-automatic weapons as recited in claim 1, further comprising means for rotating said shaft.

3. A blank firing attachment as recited in claim 2, in which said means is a socket head bolt which produces a torque for the axial movement of the shaft.

4. A blank firing attachment as recited in claim 1, wherein the slidable cam means is integral with each of said locking lugs.

* * * * *